US007913439B2

(12) United States Patent
Whaley

(10) Patent No.: US 7,913,439 B2
(45) Date of Patent: Mar. 29, 2011

(54) ACCESSORY MOUNT

(76) Inventor: Alan E. Whaley, Kansas City, MO (US)

( * ) Notice: Subject to any disclaimer, the term of this patent is extended or adjusted under 35 U.S.C. 154(b) by 260 days.

(21) Appl. No.: 11/701,307

(22) Filed: Jan. 30, 2007

(65) Prior Publication Data

US 2007/0289192 A1 Dec. 20, 2007

Related U.S. Application Data

(60) Provisional application No. 60/763,219, filed on Jan. 30, 2006.

(51) Int. Cl.
*F41A 15/00* (2006.01)

(52) U.S. Cl. ..... 42/90; 42/124; 42/131; 362/110

(58) Field of Classification Search ..... 42/90, 124, 42/125, 131; 362/110
See application file for complete search history.

(56) References Cited

U.S. PATENT DOCUMENTS

| | | | | |
|---|---|---|---|---|
| 5,806,228 | A | 9/1998 | Martel et al. | |
| 6,185,854 | B1 | 2/2001 | Solinsky et al. | |
| 6,508,026 | B1 | 1/2003 | Uppiano et al. | |
| 6,606,813 | B1 | 8/2003 | Squire et al. | |
| 2004/0000083 | A1* | 1/2004 | Grant, Jr. | 42/112 |
| 2006/0075674 | A1* | 4/2006 | Ding | 42/124 |

* cited by examiner

*Primary Examiner* — J. Woodrow Eldred
(74) *Attorney, Agent, or Firm* — Erickson, Kernell, Derusseau & Kleypas, LLC

(57) ABSTRACT

An accessory mount for a rifle for mounting a scope at an offset angle and a flashlight without obscuring the open sight of the rifle.

1 Claim, 5 Drawing Sheets

Fig. 7
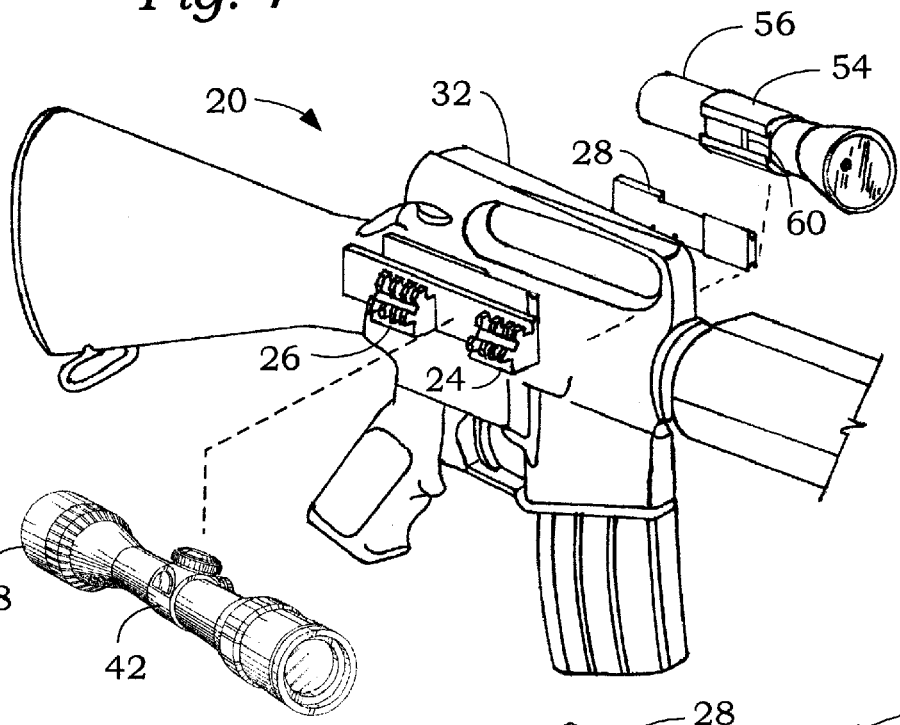
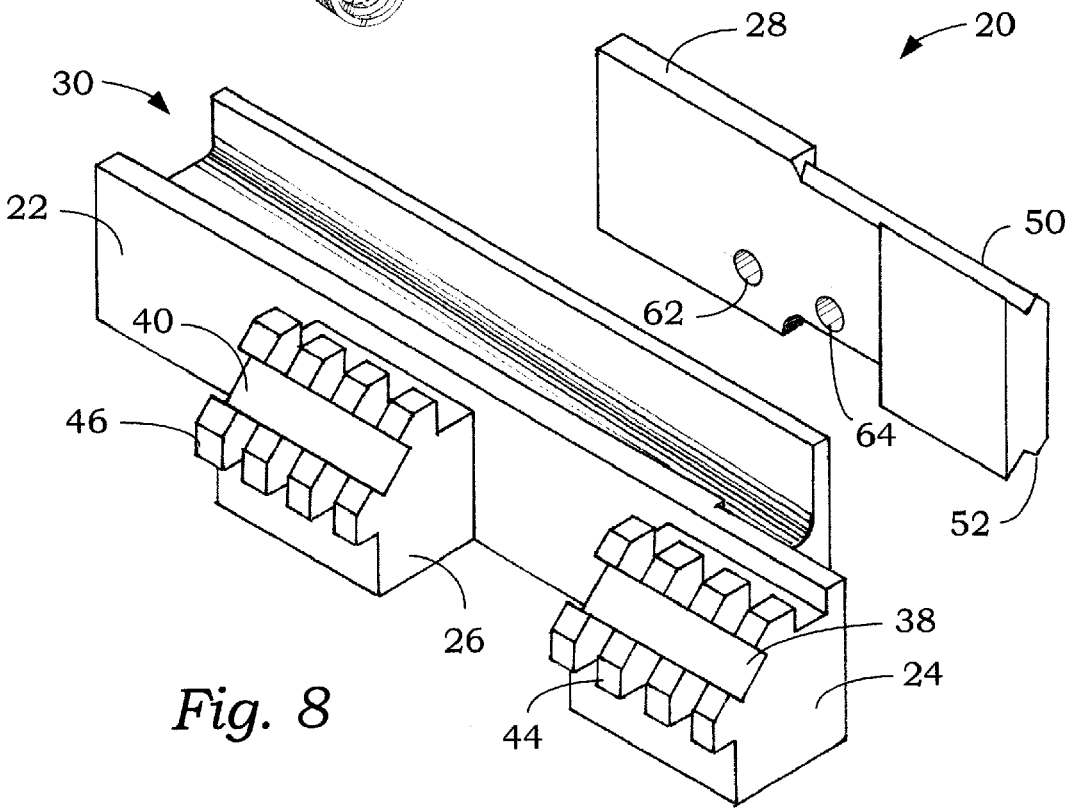
Fig. 8

ACCESSORY MOUNT

CROSS REFERENCE

This application claims the benefit of previously filed provisional application Ser. No. 60/763,219, filed Jan. 30, 2006, entitled ACCESSORY MOUNT.

FIELD OF THE INVENTION

The present invention relates to accessory mounts for rifles and, more particularly, to an accessory mount for a rifle with an offset scope mount and/or a side light mount.

BACKGROUND OF THE INVENTION

Various mounts for securing accessories such as a scope or light, for example, to a rifle are known in the art. Typically these mounts are secured to the rifle above the receiver or above the barrel in line with the rifle's open sights and a scope or other accessory is attached to the mount.

One problem with these mounts is they often obscure the open sight on the rifle and require removal when the scope or other accessory is not used. Another problem is when using the rifle with protective head or face gear, the gear comes in contact with the butt stock of the rifle and may interfere with the use of a scope mounted on the rifle or with the normal sight.

SUMMARY OF THE INVENTION

The present invention provides an accessory mount for an M-16-type rifle with an offset mount for a scope and/or a side mount for an accessory such as a flashlight. The accessory mount may be attached to the carrying handle of an M-16-type rifle without obscuring or interfering with the open sight tunnel formed through the top of the carrying handle.

DESCRIPTION OF THE DRAWINGS

FIG. 7 is a perspective view of the accessory mount of FIG. 1 and a partial view of an M-16 rifle.

FIG. 8 is an enlarged perspective view of the accessory mount of FIG. 1.

DETAILED DESCRIPTION

Figure 1:
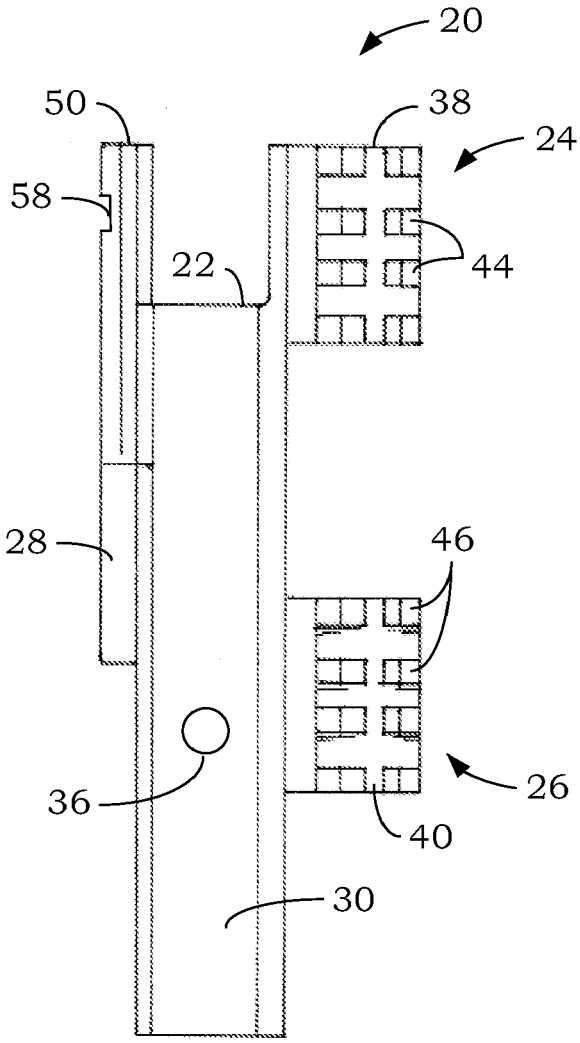
FIG. 1 is a top plan view of the accessory mount of the present invention.
Figure 2:
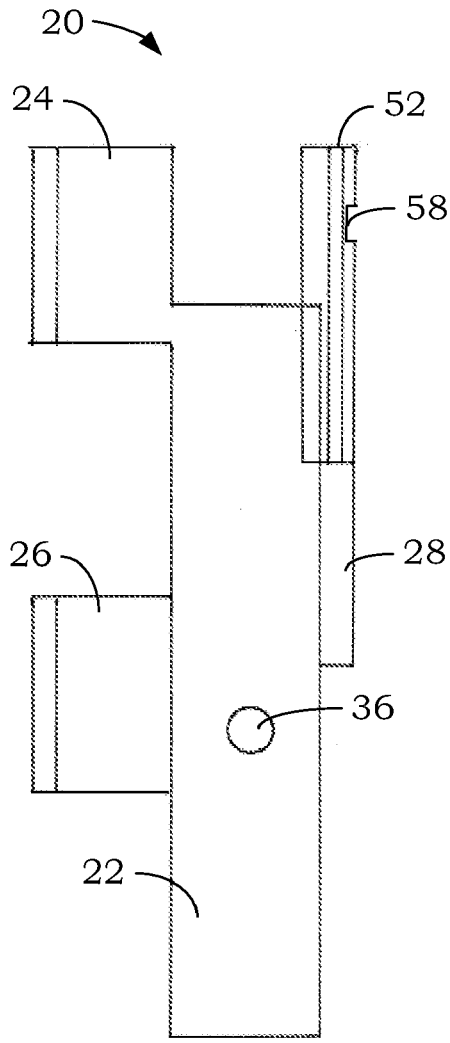
FIG. 2 is a bottom view of the accessory mount of FIG. 1.
Figure 3:
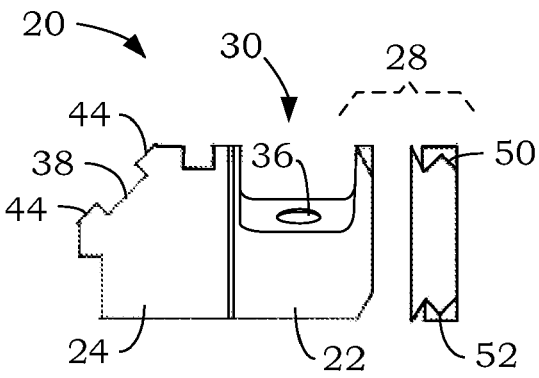
FIG. 3 is a right end view of the accessory mount of FIG. 1.
Figure 4:
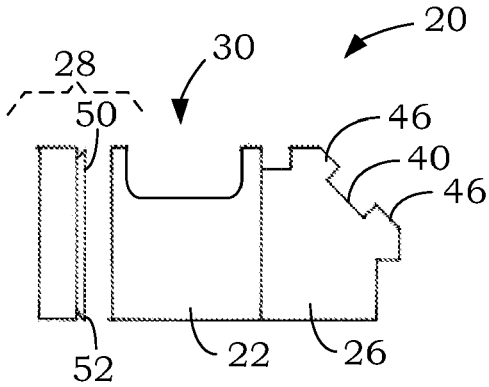
FIG. 4 is left end view of the accessory mount of FIG. 1.
Figure 5:
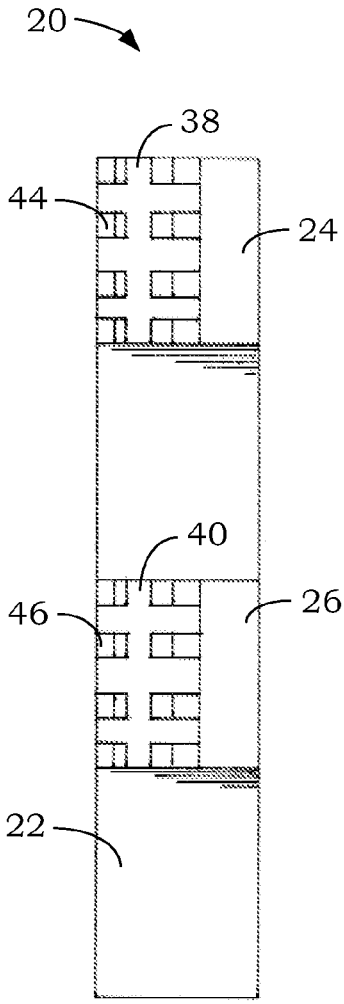
FIG. 5 is a right side view of the accessory mount of FIG. 1.
Figure 6:
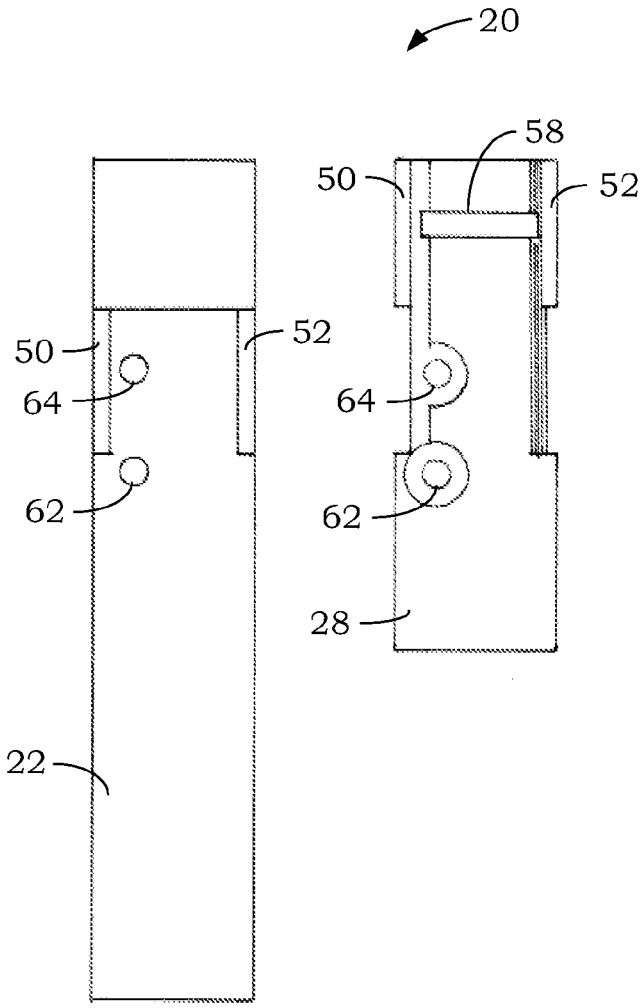
FIG. 6 is a left side view of the accessory mount of FIG. 1 with the light bracket shown removed.

Referring to FIGS. 1-8, the accessory mount of the present invention is generally indicated by reference numeral 20. Accessory mount 20 includes an elongated body 22, a pair of scope mounting blocks 24 and 26, and a light mounting bracket 28. The elongated body 22 includes a channel 30 for receiving the carrying handle 32 of an M-16-type rifle 34, and an aperture 36 for securing the accessory mount 10 to the underside of the carrying handle 32 with a bolt or other fastener (not shown). Channel 30 is angled or tapered from left to right to accommodate the angled attachment of the carrying handle 32 with respect to the rifle 34 and to mount the accessory mount level.

Scope mounting blocks 24 and 26 each include an angled mounting surface 38 and 40, respectively, for mounting a scope 42 to the accessory mount 20. Scope mounting blocks 24 and 26 each include adjustment teeth 44 and 46 extending from the angled mounting surfaces 38 and 40, respectively, for adjusting the distance from the eye piece 48 of the scope 42 to the shooter's eye.

Light mounting bracket 28 includes upper 50 and lower 52 rails or grooves adapted to slidably receive a mounting clip 54 attached to a flashlight 56. Light mounting bracket 28 also includes a transverse retention slot 58 which releasably secures a spring latch bar 60 on the mounting clip 54. The light mounting bracket 28 is secured to the body 22 of the accessory mount 20 by two machine screws or other fasteners, not shown, through apertures 62 and 64.

The accessory mount 20 is preferably machined from a solid block of hardened aluminum but may be made of other suitable materials. The configuration of the accessory mount 20 provides a shooter a better cheek to gun stock contact and thus a more stable shooting position when shooting with an optical magnification device (scope 42). When used in a military environment, an infantry or squad sniper rifleman may use the open sights on an M-16A2 while the accessory mount 20 and scope 46 are mounted on the weapon. Additionally, the offset scope 46 allows a user in full chemical gear to make an accurate shot using the scope 46.

Figure 9:
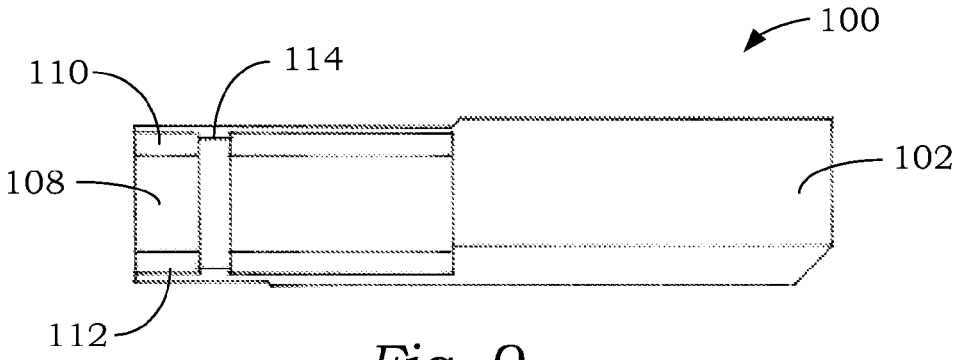
FIG. 9 is a right side view of an alternate embodiment of an accessory mount.
Figure 10:
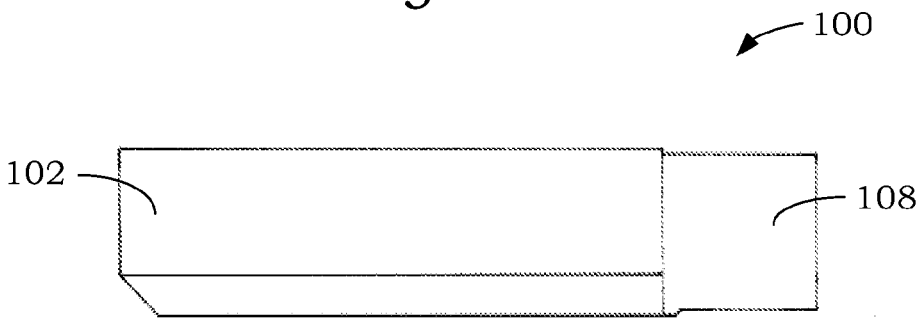
FIG. 10 is a left side view of the accessory mount of FIG. 9.
Figure 11:
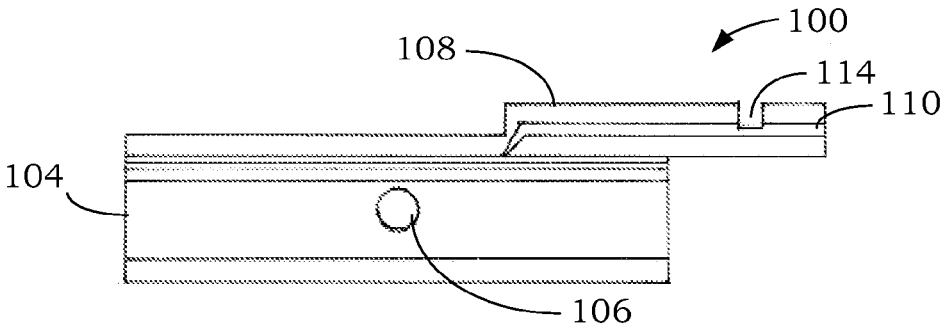
FIG. 11 is a top plan view of the accessory mount of FIG. 10.
Figure 12:
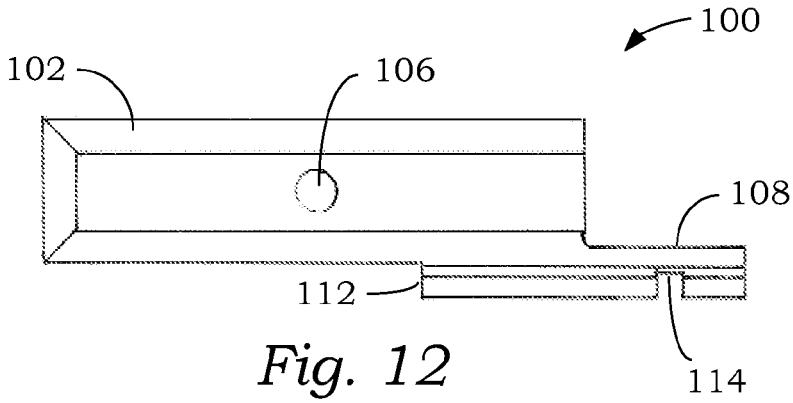
FIG. 12 is a bottom view of the accessory mount of FIG. 10.
Figure 13:
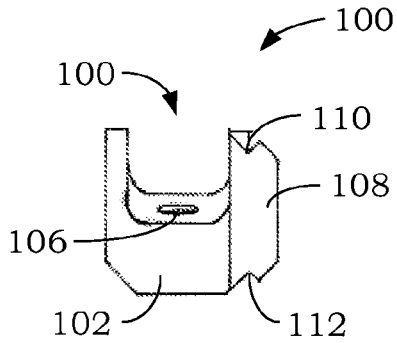
FIG. 13 is a right end view of the accessory mount of FIG. 10.
Figure 14:
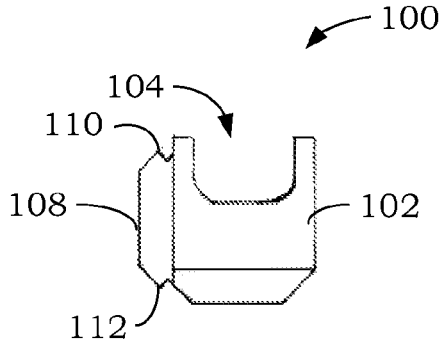
FIG. 14 is a left end view of the accessory mount of FIG. 10.
Figure 15:
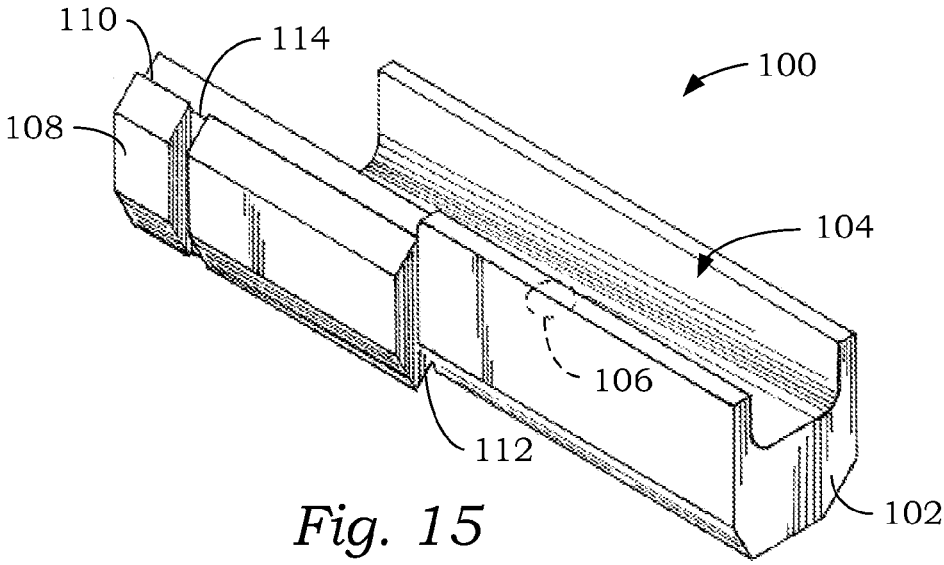
FIG. 15 is a perspective view of the accessory mount of FIG. 9.

Referring to FIGS. 9-15, an alternative embodiment of an accessory mount is generally indicated by reference numeral 100. Accessory mount 100 includes an elongated body 102 with a channel 104 for receiving the carrying handle of an M-16-type rifle, an aperture 106 for securing the accessory mount 100 to the underside of the carrying handle, and a light mounting bracket 108. Light mounting bracket 108 includes upper 110 and lower 112 rails or grooves adapted to slidably receive a mounting clip attached to a flashlight (shown in FIG. 7). Light mounting bracket 108 also includes a transverse retention slot 114 which releasably secures a spring latch bar on the flashlight mounting clip (shown in FIG. 7).

Accessory mount 100 is preferably machined from a solid block of hardened aluminum but may be fabricated from other suitable materials. The configuration of the accessory mount 100 provides the shooter with a convenient mount for a flashlight without obscuring the open sight on the rifle.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. In combination with an M-16-type rifle having a longitudinal axis and a carrying handle, said carrying handle having a lower surface and attached to said M-16-type rifle at an angle relative to said longitudinal axis, an accessory mount for attachment to said carrying handle and mounting a scope and flashlight thereto, said accessory mount comprising:

a body having an upper surface arranged in a horizontal plane, first and second spaced-apart sides arranged in parallel vertical planes, and a longitudinal channel in said upper surface between said first and second spaced-apart sides and sloping from a first end to a second end at an angle relative to said upper surface horizontal plane presenting a seat for the lower surface of the carrying handle to receive the carrying handle of the M-16-type rifle, a pair of spaced-apart blocks extending from said first side of said body, each of said blocks having a scope mounting surface arranged in a plane at an angle of 45 degrees relative to said vertical plane of said first side to mount the scope thereto, each of said blocks having spaced-apart adjustment teeth extending from said scope mounting surface to incrementally adjust the position of the scope relative to said accessory mount, a flashlight mounting bracket secured to said second side of said body having upper and lower parallel longitudinal rails and a retention slot arranged perpendicularly to said upper and lower parallel longitudinal rails, and a flashlight mounting clip secured to the flashlight having parallel spaced-apart rails adapted to slidably engage said upper and lower parallel rails of said flashlight mounting bracket, and a spring latch bar arranged perpendicularly to said parallel spaced-apart rails and adapted to releasably engage said retention slot of said flashlight mounting bracket.

* * * * *